US011609024B2

(12) United States Patent
Jin et al.

(10) Patent No.: US 11,609,024 B2
(45) Date of Patent: Mar. 21, 2023

(54) HEAT EXCHANGER, HEAT EXCHANGER MODULE, AND AIR CONDITIONING SYSTEM

(71) Applicant: Danfoss Micro Channel Heat Exchanger (Jiaxing) Co., Ltd., Zhejiang (CN)

(72) Inventors: Junfeng Jin, Nordborg (DK); Xiangxun Lu, Nordborg (DK); Pierre Olivier Pelletier, Nordborg (DK); Wenjian Wei, Nordborg (DK); Yuye Wu, Nordborg (DK)

(73) Assignee: Danfoss Micro Channel Heat Exchanger (Jiaxing) Co., Ltd., Zhejiang (CN)

( * ) Notice: Subject to any disclaimer, the term of this patent is extended or adjusted under 35 U.S.C. 154(b) by 459 days.

(21) Appl. No.: 16/327,630

(22) PCT Filed: Aug. 22, 2017

(86) PCT No.: PCT/CN2017/098445
§ 371 (c)(1),
(2) Date: Feb. 22, 2019

(87) PCT Pub. No.: WO2018/036468
PCT Pub. Date: Mar. 1, 2018

(65) Prior Publication Data

US 2019/0186783 A1 Jun. 20, 2019

(30) Foreign Application Priority Data

Aug. 26, 2016 (CN) ..... 201610739420.0

(51) Int. Cl.
*F24F 13/00* (2006.01)
*F24F 13/30* (2006.01)
(Continued)

(52) U.S. Cl.
CPC ..... *F24F 13/30* (2013.01); *F25B 39/00* (2013.01); *F28D 7/0066* (2013.01); *F28F 9/02* (2013.01)

(58) Field of Classification Search
CPC ..... F28D 1/05366; F28D 7/00; F24F 13/30; F24F 9/02; F25B 39/00
See application file for complete search history.

(56) References Cited

U.S. PATENT DOCUMENTS

2004/0240625 A1 12/2004 Kendall
2007/0204978 A1 9/2007 Beamer
(Continued)

FOREIGN PATENT DOCUMENTS

CN 101251319 A 8/2008
CN 202017547 U 10/2011
(Continued)

OTHER PUBLICATIONS

Notice of the Reason for Refusal for Japanese Patent Application No. 2019-510594 dated Apr. 6, 2021 and its English Translation.
English Translation of Notice of Grounds for Rejection for Korean Patent Application No. 10-2019-7006591 dated Mar. 11, 2021.
(Continued)

*Primary Examiner* — Harry E Arant
(74) *Attorney, Agent, or Firm* — McCormick, Paulding & Huber PLLC

(57) ABSTRACT

A heat exchanger (100), a heat exchanger module (100') having the heat exchanger (100), and an air conditioning system having the heat exchanger (100) or the heat exchanger module (100'); the heat exchanger (100) comprises: a first header (11) and a second header (12), with an axis of the first header (11) being inclined relative to an axis of the second header (12); and a heat exchange pipe (2) connected to the first header (11) and the second header (12),
(Continued)

the heat exchange pipe (2) being bent. The heat exchange efficiency can be increased by using the heat exchanger (100).

16 Claims, 6 Drawing Sheets

(51) Int. Cl.

| | |
|---|---|
| ***F25B 39/00*** | (2006.01) |
| ***F28D 7/00*** | (2006.01) |
| ***F28F 9/02*** | (2006.01) |

(56) References Cited

U.S. PATENT DOCUMENTS

| | | | | |
|---|---|---|---|---|
| 2008/0173434 | A1 | 7/2008 | Matter et al. | |
| 2012/0227944 | A1 * | 9/2012 | Moisidis | F28D 1/05383 165/172 |

FOREIGN PATENT DOCUMENTS

| | | | | | |
|---|---|---|---|---|---|
| CN | 103925742 | A | | 7/2014 | |
| CN | 103925742 | B | * | 6/2016 | F28D 1/0471 |
| CN | 105737634 | A | | 7/2016 | |
| CN | 205980447 | U | | 2/2017 | |
| EP | 1832833 | A2 | | 9/2007 | |
| GB | 920836 | | | 3/1963 | |
| JP | S56-36352 | A | | 4/1981 | |
| JP | 2000-97579 | A | | 4/2000 | |
| JP | 2001-124359 | A | | 5/2001 | |
| JP | 2007-506931 | A | | 3/2007 | |
| JP | 2015-7503 | A | | 1/2015 | |
| WO | 2016091021 | A1 | | 6/2016 | |
| WO | 2016091026 | A1 | | 6/2016 | |

OTHER PUBLICATIONS

European Search Report for Serial No. EP 17842891.8 dated Apr. 28, 2020.
International Search Report for Serial No. PCT/CN2017/098445 dated Nov. 10, 2017.
First Examination Report for Indian Patent Application No. 201917005712 dated Dec. 10, 2020.

* cited by examiner

HEAT EXCHANGER, HEAT EXCHANGER MODULE, AND AIR CONDITIONING SYSTEM

CROSS-REFERENCE TO RELATED APPLICATION

This application is a National Stage application of International Patent Application No. PCT/CN2017/098445, filed on Aug. 22, 2017, which claims priority to Chinese Patent Application No. 201610739420.0, filed on Aug. 26, 2016, each of which is hereby incorporated by reference in its entirety.

TECHNICAL FIELD

The embodiments of the present invention relate to a heat exchanger, a heat exchanger module having the heat exchanger, and an air conditioning system having the heat exchanger or the heat exchanger module.

BACKGROUND

A heat exchanger comprises headers, heat exchange pipes connected to the headers, and fins disposed between the heat exchange pipes.

SUMMARY

An object of the embodiments of the present invention is to provide a heat exchanger, a heat exchanger module having the heat exchanger, and an air conditioning system having the heat exchanger or the heat exchanger module, whereby for example, the heat exchange efficiency can be increased.

An embodiment of the present invention provides a heat exchanger, comprising: a first header and a second header, with an axis of the first header being inclined relative to an axis of the second header; and a heat exchange pipe connected to the first header and the second header, the heat exchange pipe being bent.

According to an embodiment of the present invention, the heat exchange pipe has an arcuate shape.

According to an embodiment of the present invention, the heat exchange pipe has an arcuate shape, with the center of a circle being substantially located at a point of intersection of the axis of the first header and the axis of the second header.

According to an embodiment of the present invention, the heat exchange pipe has an arcuate shape, with the center of a circle being located at a side where a distance between the first header and the second header is narrower.

According to an embodiment of the present invention, the heat exchange pipe comprises a first part connected to the first header and a second part connected to the second header, the first part being inclined relative to the second part.

According to an embodiment of the present invention, the first part and the second part are formed by bending a middle part of the heat exchange pipe.

According to an embodiment of the present invention, the heat exchange pipe comprises a first part connected to the first header, a second part connected to the second header, and a third part located between the first part and the second part, with the first part and the second part being inclined relative to the third part.

According to an embodiment of the present invention, an included angle between the first part and the third part is substantially equal to an included angle between the second part and the third part.

According to an embodiment of the present invention, the first part is substantially perpendicular to the first header, and the second part is substantially perpendicular to the second header.

According to an embodiment of the present invention, the first header, the second header and the heat exchange pipe are substantially in the same plane.

According to an embodiment of the present invention, the heat exchange pipe protrudes to one side of a plane defined by the first header and the second header.

According to an embodiment of the present invention, the heat exchange pipes have substantially the same length.

According to an embodiment of the present invention, at least a part of the heat exchange pipe in a length direction has an arcuate shape.

According to an embodiment of the present invention, the heat exchange pipes are arranged at substantially identical intervals.

According to an embodiment of the present invention, first openings of the first header for inserting ends of the heat exchange pipes into are arranged at substantially equal intervals in the axial direction of the first header, and second openings of the second header for inserting ends of the heat exchange pipes into are arranged at substantially equal intervals in the axial direction of the second header; the intervals between the first openings of the first header are substantially identical to the intervals between the second openings of the second header.

According to an embodiment of the present invention, the heat exchange pipes are arranged at substantially identical intervals; first openings of the first header for inserting ends of the heat exchange pipes into are arranged at substantially equal intervals in the axial direction of the first header, and second openings of the second header for inserting ends of the heat exchange pipes into are arranged at substantially equal intervals in the axial direction of the second header; the intervals between the first openings of the first header, the intervals between the second openings of the second header, and the intervals between the heat exchange pipes are substantially identical.

An embodiment of the present invention provides a heat exchanger module, comprising: the heat exchanger described above; and a rectangular heat exchanger connected to the heat exchanger described above.

An embodiment of the present invention provides an air conditioning system, comprising the heat exchanger described above, or the heat exchanger module described above.

The heat exchanger, the heat exchanger module and the air conditioning system according to embodiments of the present invention can for example increase heat exchange efficiency.

DETAILED DESCRIPTION

Figure 1:
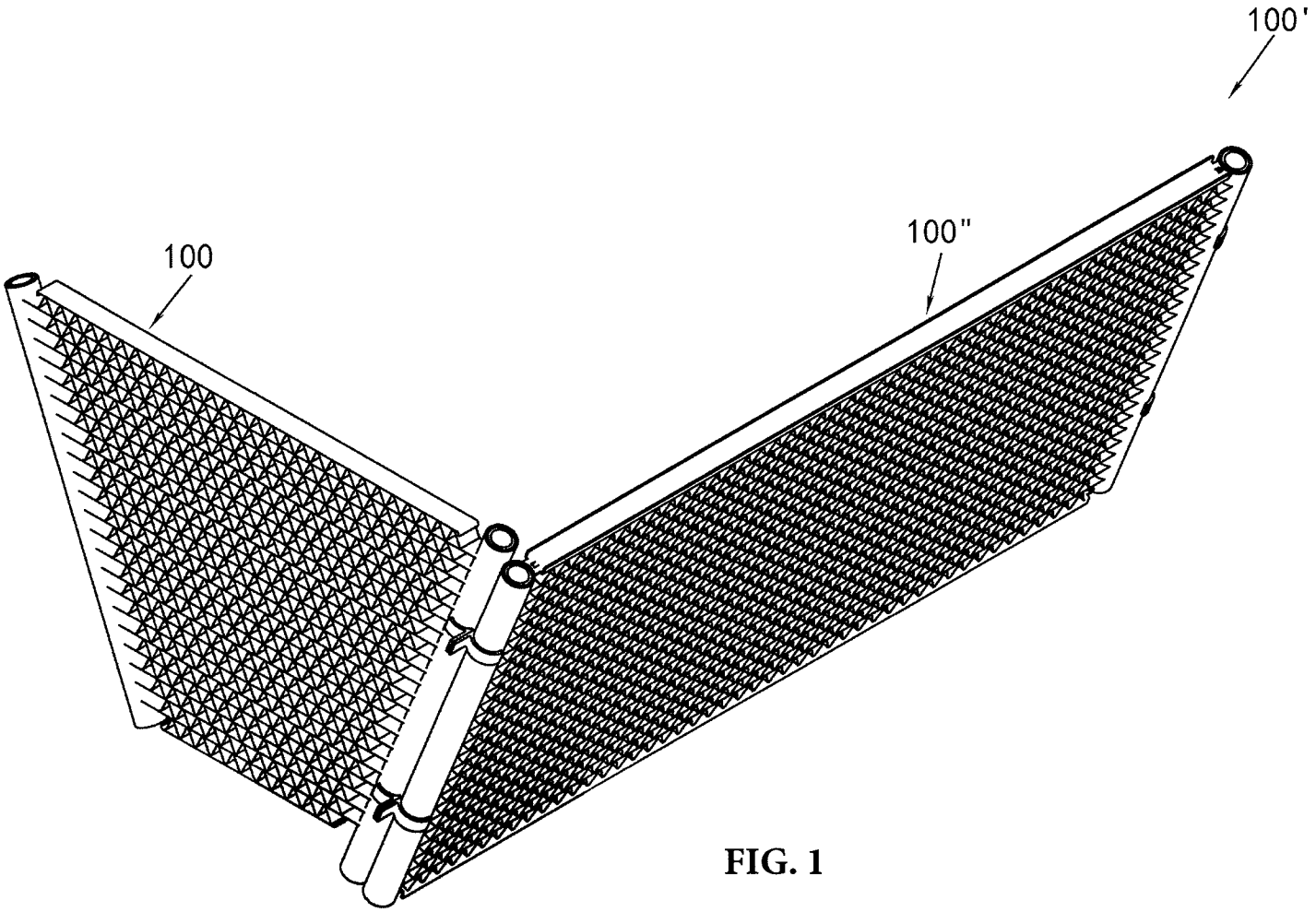
FIG. 1 is a schematic three-dimensional view of a heat exchanger module according to an embodiment of the present invention.
Figure 2:
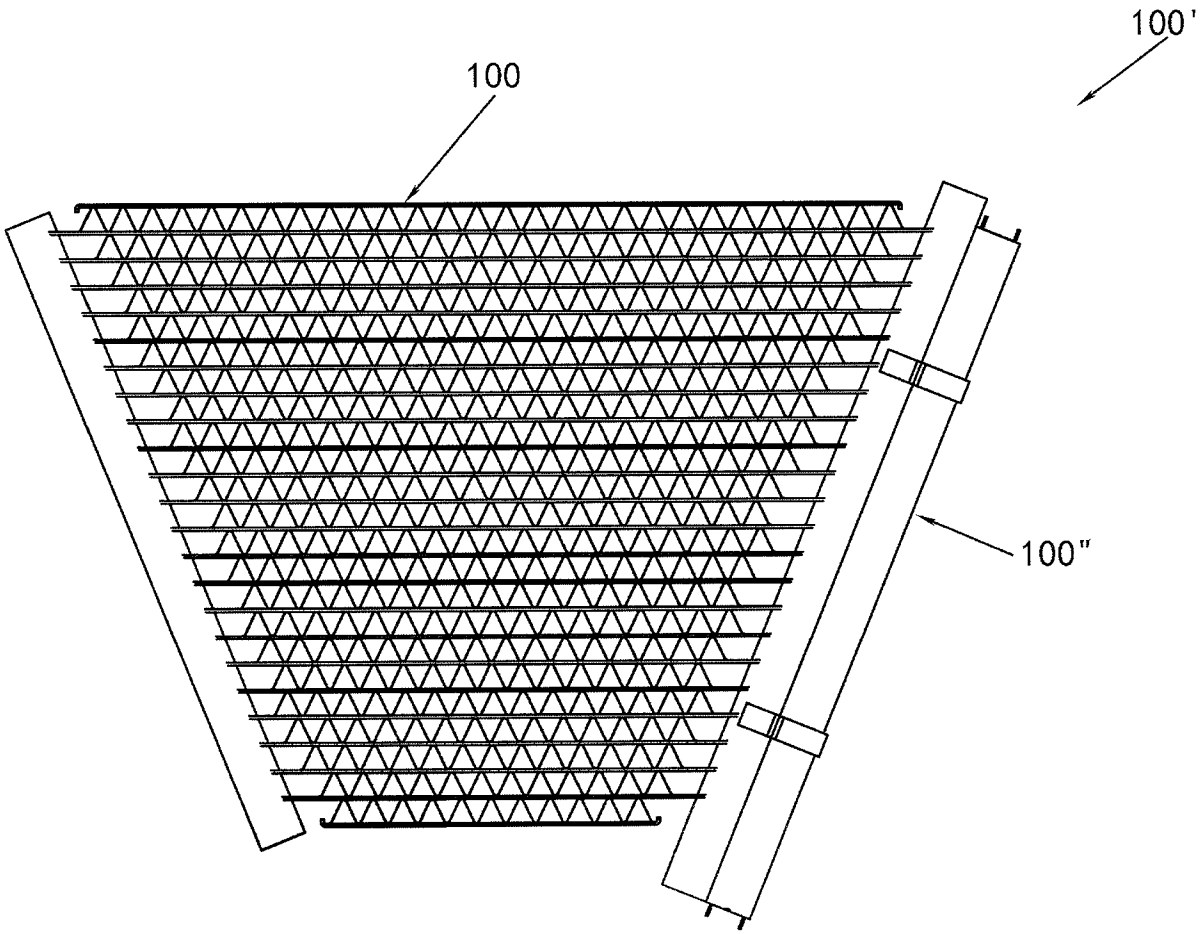
FIG. 2 is a schematic side view of a heat exchanger module according to an embodiment of the present invention.
Figure 3:
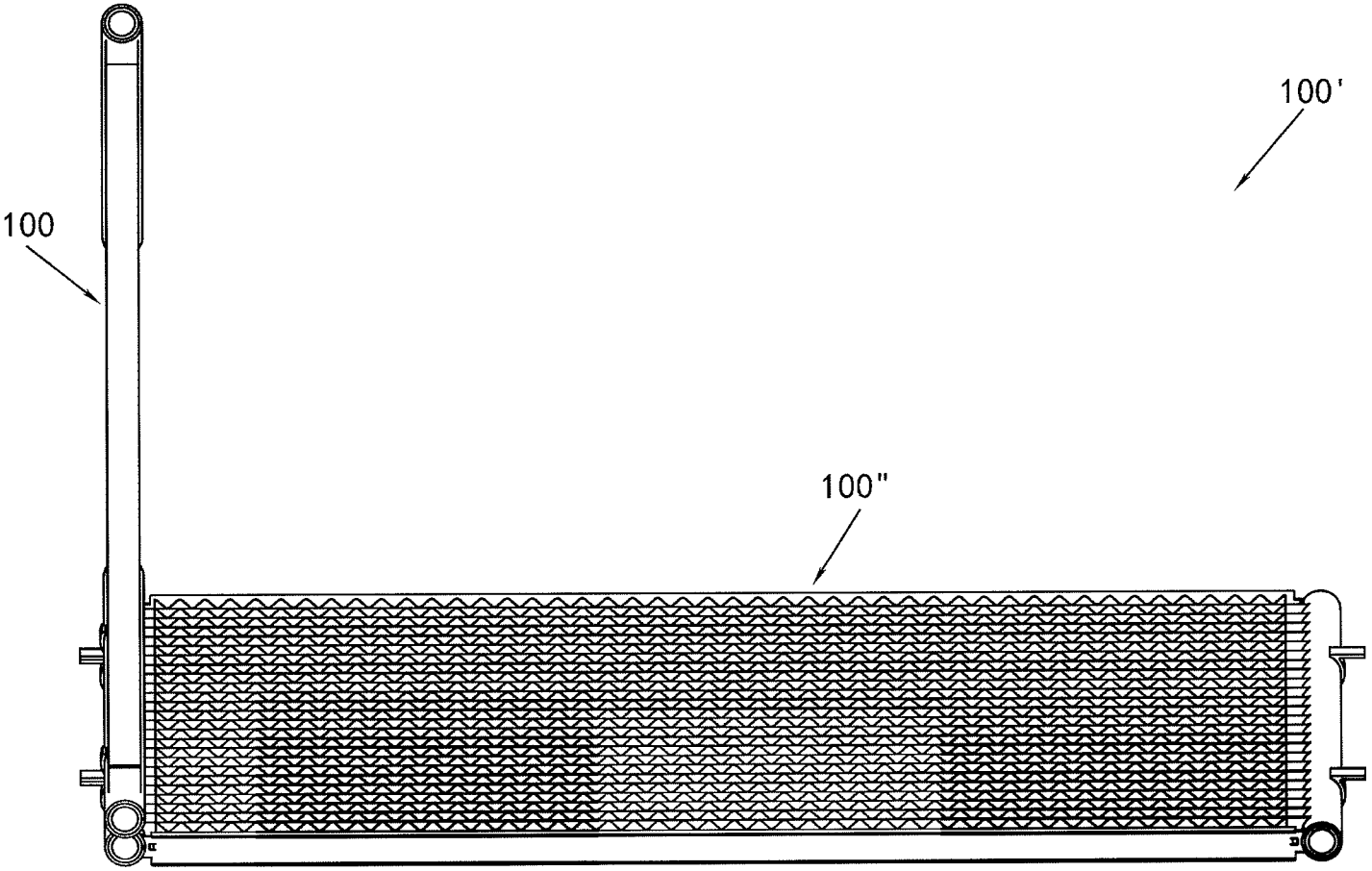
FIG. 3 is a schematic top view of a heat exchanger module according to an embodiment of the present invention.

Referring to FIGS. 1 to 10, an air conditioning system according to an embodiment of the present invention comprises a heat exchanger 100, or a heat exchanger module 100'. The heat exchanger module 100' according to an embodiment of the present invention comprises the heat exchanger 100; and a rectangular heat exchanger 100" connected to the heat exchanger 100. The air conditioning system may be an electrically driven air conditioning unit, e.g. an electrically driven air-cooled modular chiller. The heat exchanger 100 and the heat exchanger 100" may be all-aluminium microchannel heat exchangers. The heat exchanger module 100' may also comprise multiple heat exchangers 100 and multiple heat exchangers 100", e.g. two heat exchangers 100 and two heat exchangers 100" forming a rectangular ring.

Referring to FIGS. 4 to 10, the heat exchanger 100 according to an embodiment of the present invention comprises: a first header 11 and a second header 12, with an axis of the first header 11 being inclined relative to an axis of the second header 12; and heat exchange pipes 2 connected to the first header 11 and the second header 12, the heat exchange pipes 2 being bent. The heat exchanger 100 further comprises fins 3 disposed between the heat exchange pipes 2. The heat exchanger 100" comprises headers, heat exchange pipes, and fins disposed between the heat exchange pipes. The heat exchange pipes 2 may be flat pipes; the heat exchanger 100 and the heat exchanger 100" may be microchannel heat exchangers. Referring to FIGS. 4 to 10, in an embodiment of the present invention, the heat exchange pipes 2 into are arranged at substantially identical intervals.

Referring to FIGS. 4 to 10, in an embodiment of the present invention, first openings of the first header 11 for inserting ends of the heat exchange pipes 2 into are arranged at substantially equal intervals in the axial direction of the first header 11, and second openings of the second header 12 for inserting ends of the heat exchange pipes 2 into are arranged at substantially equal intervals in the axial direction of the second header 12; the intervals between the first openings of the first header 11 are substantially identical to the intervals between the second openings of the second header 12.

Referring to FIGS. 4 to 10, for example, the heat exchange pipes 2 are arranged at substantially identical intervals; the first openings of the first header 11 for inserting the ends of the heat exchange pipes 2 into are arranged at substantially equal intervals in the axial direction of the first header 11, and the second openings of the second header 12 for inserting the ends of the heat exchange pipes 2 into are arranged at substantially equal intervals in the axial direction of the second header 12; the intervals between the first openings of the first header 11, the intervals between the second openings of the second header 12, and the intervals between the heat exchange pipes 2 are substantially identical.

Figure 4:
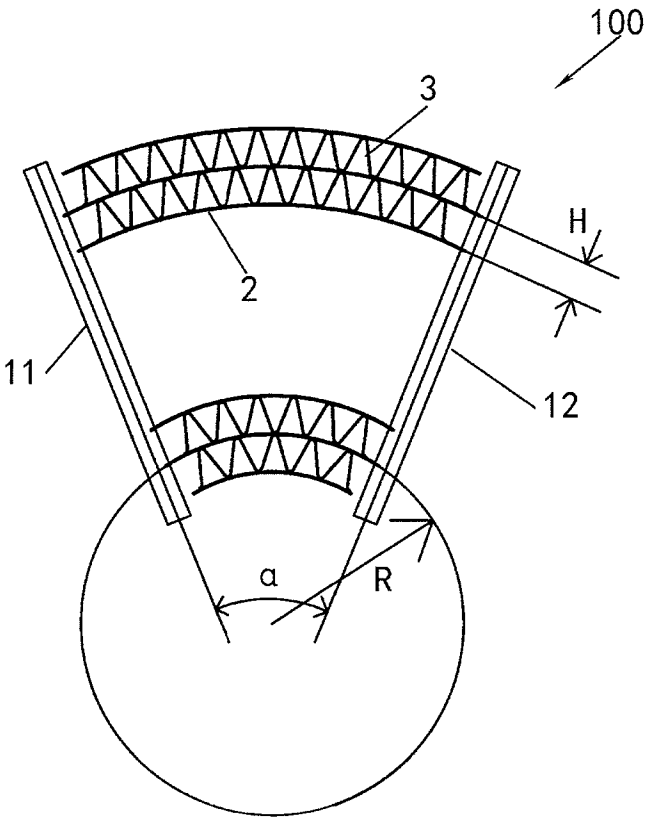
FIG. 4 is a schematic diagram of a heat exchanger according to a first embodiment of the present invention.

As shown in FIG. 4, the heat exchange pipes 2 have an arcuate shape. The center of a circle may be substantially located at a point of intersection of the axis of the first header 11 and the axis of the second header 12, or located at a side where a distance between the first header 11 and the second header 12 is narrower (the lower side in FIG. 4). The heat exchanger 100 has a substantially fan-like shape or is in the shape of an isosceles trapezium. The lengths of the heat exchange pipes 2 and the fins 3 increase progressively according to a certain rule (excluding upper and lower edge plates which have a protective function): the length of a first heat exchange pipe 2 is L1, the length of a first fin is L2, and from bottom to top, the lengths of an (n)th heat exchange pipe 2 and an (n)th fin 3 are $L1-(n-1)\pi*H*\alpha/180$ and $L2-(n-1)\pi*H*\alpha/180$ respectively, wherein the interval between the openings of the headers is H, a center-to-center spacing of the heat exchange pipes 2 is H, an included angle between the first header 11 and the second header 12 is $\alpha$, and a bending radius of the heat exchange pipe 2 is R. In the heat exchanger of this embodiment of the present invention, the interval between the openings of the headers is the same as the interval between the heat exchange pipes 2, such that the number of types of fins can be reduced; for example, when the heat exchanger 100 and the rectangular heat exchanger 100" are assembled for use, only one type of fin is needed.

Figure 5:
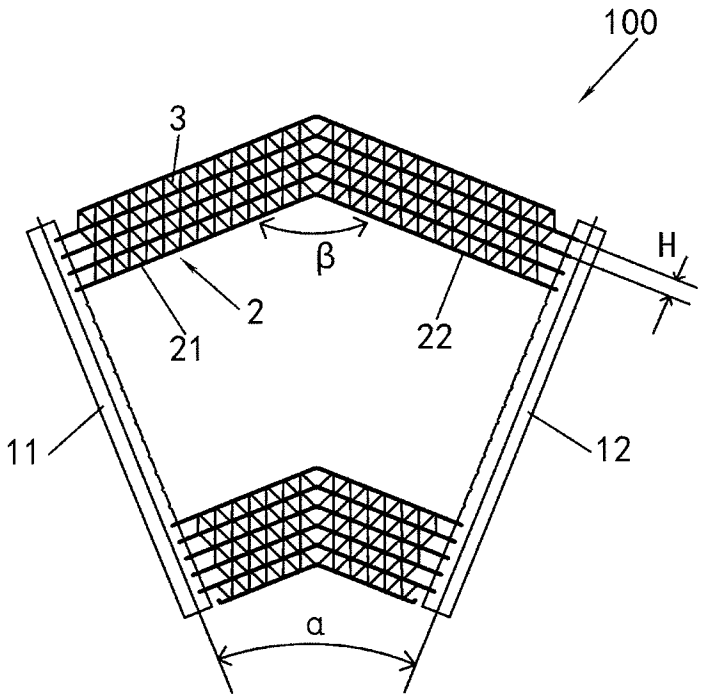
FIG. 5 is a schematic diagram of a heat exchanger according to a second embodiment of the present invention.
Figure 7:
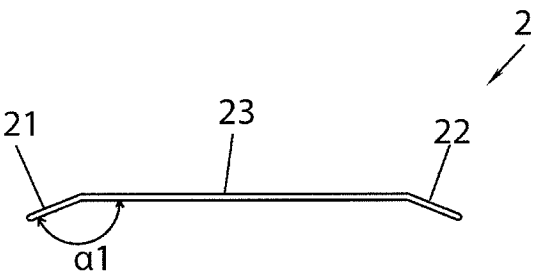
FIG. 7 is a schematic diagram of heat exchange pipe of the heat exchanger according to the third embodiment of the present invention.
Figure 6:
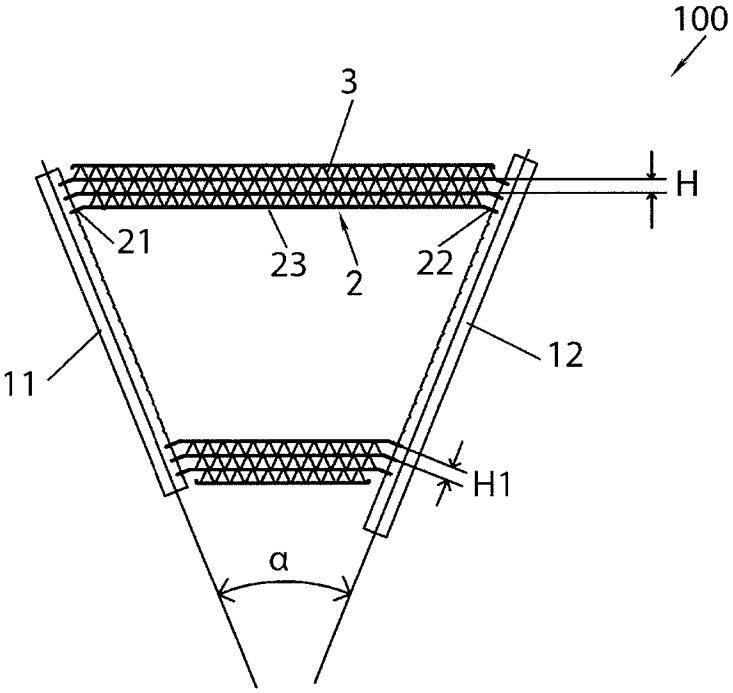
FIG. 6 is a schematic diagram of a heat exchanger according to a third embodiment of the present invention.

As shown in FIGS. 5 to 7, the heat exchange pipe 2 comprises a first part 21 connected to the first header 11 and a second part 22 connected to the second header 12; the first part 21 is inclined relative to the second part 22. For example, as shown in FIG. 5, the first part 21 and the second part 22 are formed by bending a middle part of the heat exchange pipe 2.

As shown in FIGS. 6 and 7, the heat exchange pipe 2 comprises a first part 21 connected to the first header 11, a second part 22 connected to the second header 12, and a third part 23 located between the first part 21 and the second part 22; the first part 21 and the second part 22 are inclined relative to the third part 23. For example, an included angle between the first part 21 and the third part 23 is substantially equal to an included angle between the second part 22 and the third part 23.

In an embodiment of the present invention, as shown in FIGS. 5 to 7, the first part 21 is substantially perpendicular to the first header 11, and the second part 22 is substantially perpendicular to the second header 12.

In an embodiment of the present invention, as shown in FIG. 5, the lengths of the heat exchange pipes 2 and the fins 3 increase progressively according to a certain rule (excluding upper and lower edge plates which have a protective function): the length of a first heat exchange pipe 2 is L1, the length of a first fin 3 is L2, and from top to bottom the lengths of an (n)th heat exchange pipe 2 and an (n)th fin 3 are $L1-2(n-1)*H*\tan(\alpha/2)$ and $L2-2(n-1)*H*\tan(\alpha/2)$ respectively, wherein the interval between the openings of the headers is H, the center-to-center spacing of the heat exchange pipes 2 is H, the included angle between the first header 11 and the second header 12 is $\alpha$, and a bending angle of the heat exchange pipes 2 is $\beta=180°-\alpha$. In this embodiment of the present invention, the heat exchange pipes are bent in the middle, and the ends of the heat exchange pipes 2 are inserted perpendicularly into the headers. In the heat exchanger according to an embodiment of the present invention, the interval between the openings of the headers is the same as the interval between the heat exchange pipes 2; for example, when the heat exchanger 100 and the rectangular heat exchanger 100" are assembled for use, fins of identical height, and headers having identical intervals between the openings for inserting the ends of the heat exchange pipes 2 into can be used. In addition, the ends of the heat exchange pipes 2 are inserted perpendicularly into the headers, such that the openings in the headers for the insertion of the heat exchange pipes 2 can be machined conveniently.

As shown in FIGS. 6 and 7, in an embodiment of the present invention, the lengths of the heat exchange pipes 2 and the fins 3 decrease progressively according to a certain rule: supposing that the length of a first heat exchange pipe 2 is L1, and the length of a first fin is L2; from top to bottom, the lengths of an (n)th heat exchange pipe 2 and an (n)th fin 3 are $L1-2(n-1)*H*\tan(\alpha/2)$ and $L2-2(n-1)*H*\tan(\alpha/2)$ respectively, wherein the center-to-center spacing of the heat exchange pipes 2 is H, the interval between the openings of the headers is $H1=H*\cos(\alpha/2)$, the bending angle of the heat exchange pipes 2 is $\alpha1=180°-(\alpha/2)$, and $\alpha$ is the included angle between the first header 11 and the second header 12. In this embodiment, the heat exchange pipes 2 are bent at both ends. The ends of the heat exchange pipes 2 are perpendicularly inserted into the headers, such that the openings in the headers for the insertion of the heat exchange pipes 2 can be machined conveniently. Thus, the machining of the heat exchanger is simple, and the heat exchange area is maximized in a limited installation space.

In an embodiment of the present invention, as shown in FIGS. 4 to 7, the first header 11, the second header 12 and the heat exchange pipe 2 are substantially in the same plane.

Figure 8:
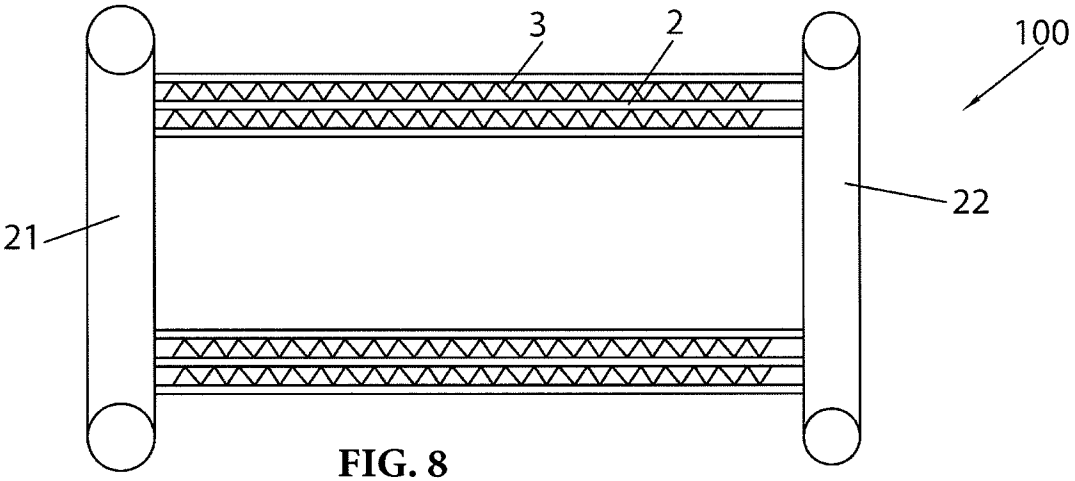
FIG. 8 is a schematic diagram of a heat exchanger according to a fourth embodiment of the present invention before bending.
Figure 9:
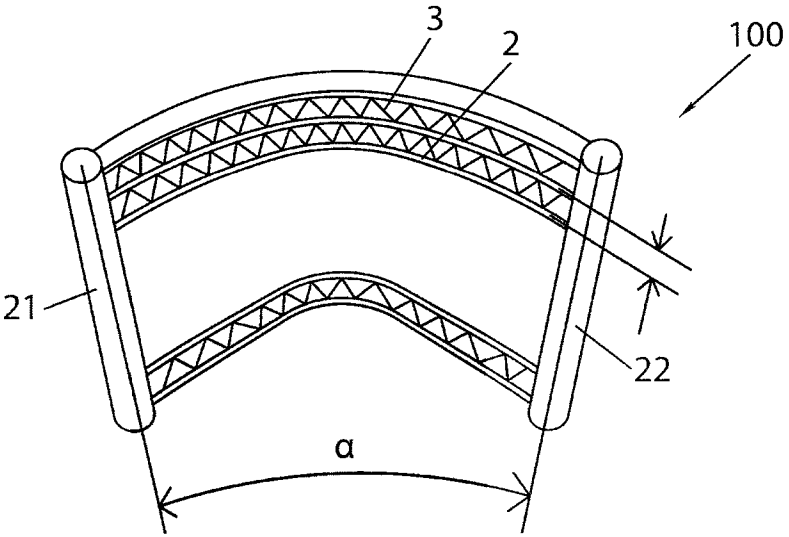
FIG. 9 is a schematic diagram of a heat exchanger according to a fourth embodiment of the present invention after bending.
Figure 10:
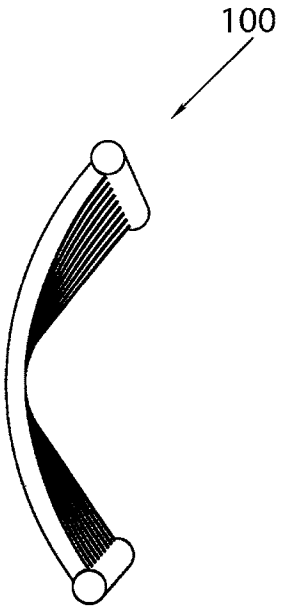
FIG. 10 is another schematic diagram of the heat exchanger according to the fourth embodiment of the present invention after bending.

As shown in FIGS. 8 to 10, the heat exchange pipes 2 protrude to one side of a plane defined by the first header 11 and the second header 12. The heat exchange pipes 2 may have substantially the same length. At least a partial region of the heat exchange pipe 2, or at least a part of the heat exchange pipe 2 in a length direction (e.g. a middle part of the heat exchange pipe 2), may have an arcuate shape.

As shown in FIGS. 8 to 10, in an embodiment of the present invention, the lengths of the heat exchange pipes 2 and the lengths of the fins 3 remain substantially identical from top to bottom. It is the bending angle and the bending radius of the heat exchange pipes 2 and the fins 3 which change, substantially according to the following rule: from top to bottom, the bending radii of the heat exchange pipes 2 and the fins 3 decrease, and the angle after bending decreases. The heat exchanger 100 according to an embodiment of the present invention is obtained substantially by bending a rectangular heat exchanger. The center-to-center spacing of the heat exchange pipes 2 is H, the interval between the openings of the headers is H, and the included angle between the first header 11 and the second header 12 is $\alpha$. According to an embodiment of the present invention, the heat exchanger is bent in its entirety, such that the heat exchange area is maximized in a limited installation space.

According to an embodiment of the present invention, surplus heat exchange space of a chiller may be used to increase the heat exchange capability and efficiency of the chiller.

The heat exchanger and the heat exchanger module according to an embodiment of the present invention are simple to assemble, convenient to transport and install (installation or individual transportation can be chosen with greater flexibility), and do not require bending or more complex processes. In addition, the heat exchanger and heat exchanger module set have a large heat exchange area, and a high space utilization rate; and an increase in the heat exchange area of greater than or equal to 20-25% is achieved (compared with a conventional rectangular heat exchanger).

In addition, the abovementioned embodiments according to the present invention may be combined to form new embodiments.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchanger, comprising:

a first header and a second header, with an axis of the first header being inclined relative to an axis of the second header; and a plurality of heat exchange pipes connected to the first header and the second header, the heat exchange pipes being bent;

wherein the plurality of heat exchange pipes comprise a first heat exchange pipe and a plurality of (n)th heat exchange pipes;

wherein the length of each (n)th heat exchange pipe is $L1-2(n-1)*H*\tan(\alpha/2)$;

wherein L1 is the length of the first heat exchange pipe;

wherein H is a center-to-center spacing of the plurality of heat exchange pipes; and wherein $\alpha$ is an included angle between the first header and the second header.

2. The heat exchanger as claimed in claim 1, wherein:

each heat exchange pipe of the plurality of heat exchange pipes comprises a first part connected to the first header and a second part connected to the second header, the first part being inclined relative to the second part.

3. The heat exchanger as claimed in claim 2, wherein:

the first part and the second part are formed by bending at a middle part of the heat exchange pipe.

4. The heat exchanger as claimed in claim 2, wherein:

the first part is perpendicular to the first header, and the second part is perpendicular to the second header.

5. The heat exchanger as claimed in claim 1, wherein:

each heat exchange pipe of the plurality of heat exchange pipes comprises a first part connected to the first header, a second part connected to the second header, and a third part located between the first part and the second part, with the first part and the second part being inclined relative to the third part.

6. The heat exchanger as claimed in claim 5, wherein:

an included angle between the first part and the third part is equal to an included angle between the second part and the third part.

7. The heat exchanger as claimed in any one of claim 6, wherein:

the first part is perpendicular to the first header, and the second part is perpendicular to the second header.

8. The heat exchanger as claimed in claim 1, wherein:

the first header, the second header and each heat exchange pipe of the plurality of heat exchange pipes are in the same plane.

9. The heat exchanger as claimed in claim 1, wherein:

each heat exchange pipe of the plurality of heat exchange pipes protrudes to one side of a plane defined by the first header and the second header.

10. The heat exchanger as claimed in claim 1, wherein:

the heat exchange pipes are arranged at identical intervals.

11. The heat exchanger as claimed in claim 1, wherein:

first openings of the first header for inserting ends of the heat exchange pipes into are arranged at equal intervals in the axial direction of the first header, and second openings of the second header for inserting ends of the heat exchange pipes into are arranged at equal intervals in the axial direction of the second header; the intervals between the first openings of the first header are identical to the intervals between the second openings of the second header.

12. The heat exchanger as claimed in claim 1, wherein:

the heat exchange pipes are arranged at identical intervals;

first openings of the first header for inserting ends of the heat exchange pipes into are arranged at equal intervals in the axial direction of the first header, and second openings of the second header for inserting ends of the heat exchange pipes into are arranged at equal intervals in the axial direction of the second header;

the intervals between the first openings of the first header, the intervals between the second openings of the second header, and the intervals between the heat exchange pipes are identical.

13. A heat exchanger module, comprising:

the heat exchanger as claimed in claim 1; and a rectangular heat exchanger connected to the heat exchanger.

14. An air conditioning system, comprising:

the heat exchanger module as claimed in claim 13.

15. An air conditioning system, comprising:

the heat exchanger as claimed in claim 1.

16. The heat exchanger as claimed in claim 1, wherein the difference in length between adjacent heat exchange pipes of the plurality of heat exchange pipes is $2*H*\tan(\alpha/2)$.

* * * * *